United States Patent [19]

Sugiura et al.

[11] 4,325,981

[45] Apr. 20, 1982

[54] METHOD OF PREVENTING COLOR ACCURATE REPRODUCTIONS USING COLOR PHOTOCOPIERS AND THE LIKE

[75] Inventors: Takeo Sugiura, Saitama; Keiji Miyajima, Chiba; Hideo Nagatomo; Kiyoshi Masui, both of Saitama, all of Japan

[73] Assignee: Toppan Printing Co., Ltd., Japan

[21] Appl. No.: 202,158

[22] Filed: Oct. 30, 1980

Related U.S. Application Data

[62] Division of Ser. No. 16,721, Mar. 2, 1979, Pat. No. 4,277,514.

[30] Foreign Application Priority Data

Mar. 7, 1978 [JP] Japan ..... 53/25662
Dec. 18, 1978 [JP] Japan ..... 53/158227

[51] Int. Cl.[3] ..... B41M 3/14; B44F 1/12
[52] U.S. Cl. ..... 427/7; 283/8 R
[58] Field of Search ..... 427/7; 283/8 R

[56] References Cited

U.S. PATENT DOCUMENTS 1,002,600 9/1911 Bawtree et al. ..... 427/7
1,692,405 11/1928 Freeman ..... 427/7
3,679,448 7/1972 Tramposch ..... 427/7
3,679,449 7/1972 Nagot et al. ..... 427/7
3,713,861 1/1973 Sharp ..... 427/7
3,852,088 12/1974 Godlewski et al. ..... 427/7
4,066,280 1/1978 LaCapria ..... 427/7

*Primary Examiner*—Michael R. Lusignan
*Assistant Examiner*—Janyce A. Bell
*Attorney, Agent, or Firm*—McGlew and Tuttle

[57] ABSTRACT

A method of preventing color accurate reproduction of a colored pattern with color photocopiers or color photography using photosensitive materials having spectral sensitivity in the wavelength ranges consisting of the human visible range and the adjacent wavelength ranges thereto, comprising, forming at least portion of the colored pattern with a color material having a spectral reflection factor curve with high spectral reflection in at least one of the areas of wavelength below 450 nm and above 650 nm so that a reproduction of the colored pattern is in a color not perceivable by a direct human viewer of the colored pattern. The color material also has at least one high spectral reflection peak or area within the human visible wavelength range so that the perceived color of the colored pattern is different from a reproduced color using color photocopiers or photography.

6 Claims, 6 Drawing Figures

METHOD OF PREVENTING COLOR ACCURATE REPRODUCTIONS USING COLOR PHOTOCOPIERS AND THE LIKE

The present invention is a divisional application of applicant's previous application having Ser. No. 016,721 filed Mar. 2, 1979, now U.S. Pat. No. 4,277,514, patented July 7, 1981.

BACKGROUND OF THE INVENTION

The present invention relates to objects such as documents and the like which have colored areas thereon that area difficult or impossible to reproduce using known color photocopiers or color photography wherein the photosensitive emulsions or materials used in the photocopiers or photography are sensitive both to reflections from the visible light wavelength range for humans and ranges adjacent thereto.

The recently developed technology for reproduction of colored pattern which utilizes sensitive emulsion or material, such as color photography and color copiers, is capable of reproducing patterns in a color which appears to be identical to that of the original. A potential undesirable application of this convenient technology is in unauthorized and criminal reproduction of valuable documents or color objects. Particularly when it is utilized for reproduction of paper money, stock certificates, bond certificates, stamps, checks, drafts, bills of lading, letters of guarantee, credit cards, various certificates, various coupons, various slips, and/or the objects with such nature, and if the reproductions of such objects should circulate in the market place or through various transactions, it would evidently cause disturbances in economic and financial activities, and would be serious enough to require action to maintain social justice.

Included in the means available in the prior art which are applicable for prevention of forgery of such objects of value are:

(1) The employment of particular kinds of paper such as paper having watermarks;

(2) Utilization of particular patterns such as fine, minute and/or complicated background camouflages or ground designs and hidden marks;

(3) Utilization of a particular process for representation of patterns such as mandatory employment of particular and sophisticated engraving machines for the production of plates;

(4) Employment of a particular, sophisticated and expensive printing process such as Sammel druck machines; and Each of these means is inevitably accompanied by cost disadvantages. In addition, the recent development in the aforementioned technology for reproduction of colored patterns which is excellent in performance and simple in handling operation, has added another disadvantage to these conventional means for the prevention of reproduction. When a colored object is reproduced either directly with such color reproduction technology or indirectly with such technology which is utilized for production of blocks or plates with which printing will be made, some magnitude of discrepancy would be recognized between an original and the reproduction from the viewpoint of visibility, dimensional distortion of patterns and/or paper quality. Experts however, often have a difficult time identifying a colored object as a reproduction. Particularly, in view of the fact that ordinary transactions are carried out by personnel who are not professional in this technical field and who do not have or use sufficient time for making sure of the validity of paper money, securities and/or documents to be transferred by some means including direct comparison with the genuine piece, it would be unrealistic to assume that the aforementioned color reproduction technology will not be applied to the undesirable purposes of forgery.

Prior art techniques are known for thwarting unauthorized black and white reproductions of patterns which utilize camouflaging or distorting backgrounds and the like. Such prior art teaching is not drawn to color reproductions not to the particular method employed here.

SUMMARY OF THE INVENTION

Accordingly an object of the present invention is to provide a method of preventing color accurate reproduction of a colored pattern with photocolor copiers and color photography using photosensitive materials having spectral sensitivity in the wavelength ranges consisting of the human visible range and the adjacent wavelength ranges thereto, comprising, forming at least a portion of the colored pattern with a color material having a spectral reflection factor curve with high spectral reflection in at least one of the areas of wavelength below 450 nm and above 650 nm so that a reproduction of a colored pattern is in a color not perceivable by a direct human viewer of the colored pattern.

A further object of the invention is to provide such a method including forming at least portion of the colored pattern with color material having high spectral reflection in addition, within the human visible wavelength range at at least one location thereof so that the color perceived by direct observation of the pattern is different from that which is reproduced by the color photocopiers or color photography.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

Silver halogenide, zinc oxide, cadmium sulfide, and the like are presently utilized as the photosensitive emulsion or material employed for reproduction of colored patterns using color photography and color copiers. Out of such photosensitive emulsions or materials, silver halogenides generally show the spectral characteristics as illustrated in FIGS. 1 and 2.

Figure 1:
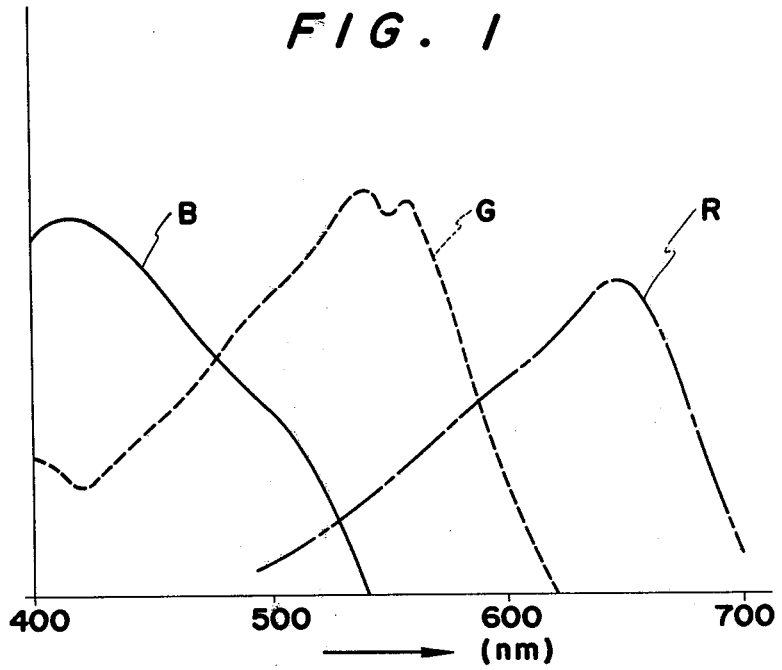
FIG. 1 is a diagram showing the special sensitivity of each photosensitive layer of the silver halogenide photosensitive emulsions respectively sensitive to three kinds of elementary color; blueviolet, green and red.

FIG. 1 is a diagram showing the spectral sensitivity of each photosensitive layer of the silver halogenide photosensitive emulsions respectively sensitive to three kinds of elementary color; blueviolet (curve B), green (curve G) and red (curve R). While a photosensitive layer that is sensitive to blueviolet is expected to have a uniform sensitivity to the wavelength of light covering 400 nm through 500 nm, it actually has an irregular sensitivity in the wavelength range from slightly longer than 400 nm through considerably longer than 500 nm. While another photosensitive layer that is sensitive to green is expected to have a uniform wavelength covering 500 nm through 600 nm, it actually has an irregular sensitivity having double peaks around the middle of the wavelength range covering considerably shorter than 500 nm through considerably longer than 600 nm. Similarly, while the third photosensitive layer that is sensitive to red is expected to have a uniform sensitivity to the wavelength range covering 600 nm through 700 nm, it actually has an irregular sensitivity having a peak or a cliff (a pair of horizontal lines connected by a vertical line to form two levels with different elevations) in the middle of the wavelength range between 600 nm and 700 nm and covering a wide wavelength range from slightly longer than 500 nm through approximately 700 nm.

Figure 2:
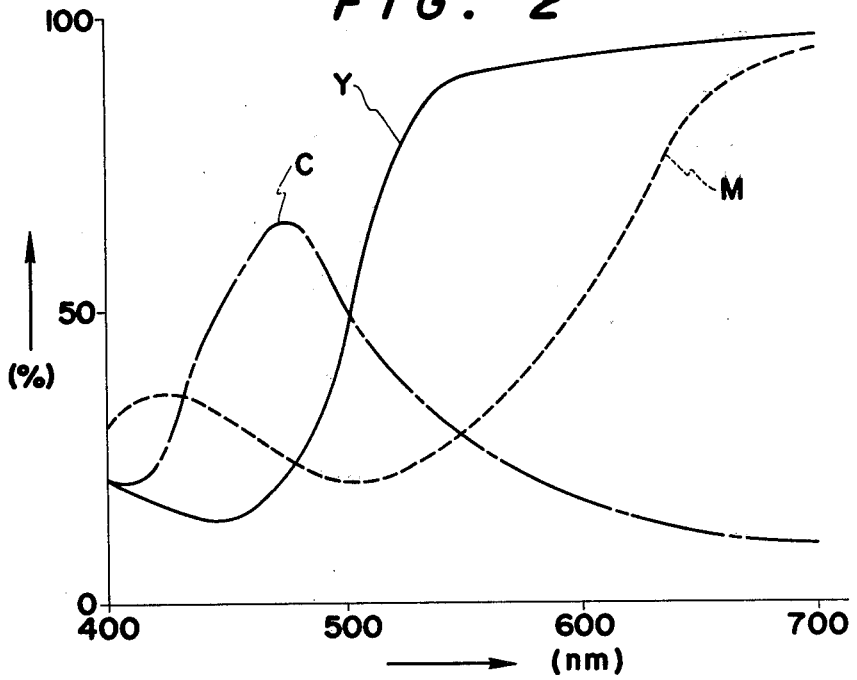
FIG. 2 is a diagram showing the spectral reflection factor of three kinds of presently available silver halogenide-based coloring matter each of which respectively develops colors; cyan, magenta and yellow on a color photograph.

FIG. 2 is a diagram showing the spectral reflection factor of three kinds of presently available silver halogenide-based coloring matter each of which respectively develops three independent colors; cyan (curve C), magenta (curve M) and yellow (curve Y), on a color photograph. Each of these colors is developed in each color developing layer of a colorphotograph, keeping some quantitative relations with the magnitude of exposure of each of the aforementioned photosensitive layers, based on the principles defined in the subtractive color mixing process. It is well known that the three colors of the coloring matter are perspectively complementary colors of the three elementary colors. The following is noted in FIG. 2: (1) While yellow is expected to uniformly cover the wavelength range of 500 nm–700 nm, the actual reflection factor extends to the wavelength range of 400 nm–500 nm. (2) While magenta is expected to uniformly cover the two independent wavelength ranges of 400–500 nm and 600–700 nm, it actually does not show the expected magnitude of reflection factor in the wavelength range of 400–500 nm. (3) While cyan is expected to uniformly cover the wavelength range of 400–600 nm, it has a triangle peak around the wavelength range slightly shorter than 500 nm, although it scarcely covers the entire expected wavelength range.

In accordance with the subtractive color mixing process, which is used in the technology for reproducing colored patterns to be made by utilizing photosensitive emulsion or material, the photosensitive layer exposed to blueviolet is developed by superposition of cyan and magenta, the layer exposed to green is developed by superposition of cyan and yellow, and the layer exposed to red is developed by superposition of magenta and yellow.

Figure 3:
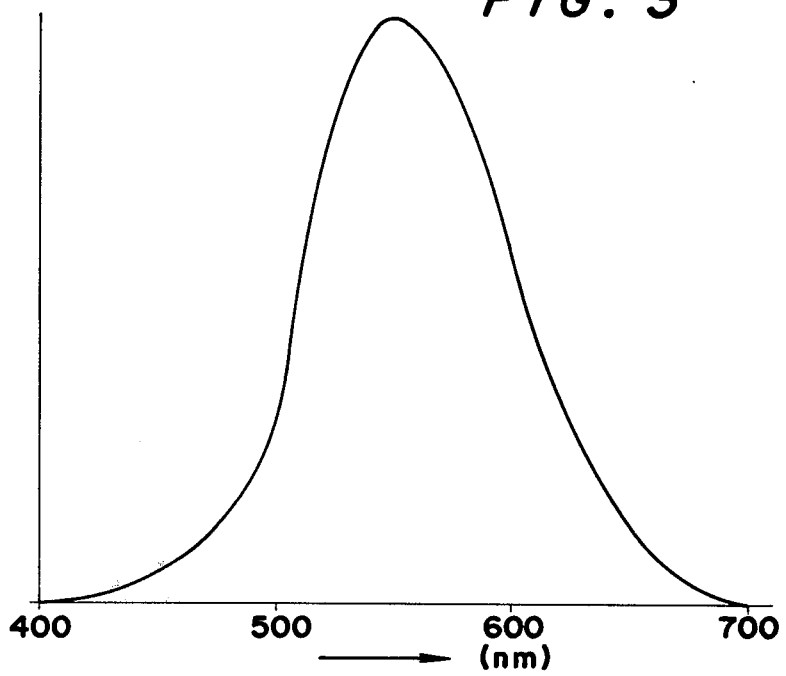
FIG. 3 is the human relative luminosity curve shown in the visible wavelength range.

FIG. 3 is the human relative luminosity curve. Referring to the figure, the magnitude or sensitivity of the human sense of sight varies depending on the wavelength of light to be seen and has a wide dispersion, ranging from 450 nm to 650 nm and centering around 550 nm. A certain intensity of light thus gives the human sense of sight a different magnitude of impression, depending on the range of wavelength of the light. Light with a wavelength close to 550 nm is thus sensed more strongly than light with a wavelength close to 400–450 nm or 650–700 nm. Also, it is seen that the human sense of sight is marginal in the wavelength ranges of 400–450 nm and 650–700 nm.

If a pattern is represented with a kind of coloring matter whose spectral reflection is limited to the wavelength range close to 700 nm, it can scarcely be seen or recognized as a color by humans because the reflection of such coloring matter can not stimulate the human eye. However, if the photosensitive emulsions or materials having the sensitivity as shown in FIG. 1 are employed, when the subtractive color mixing process is applied to reproduction of a pattern represented with the aforementioned kind of coloring matter, the reproduction will be represented by superposition of yellow and magenta both of which may be developed with the same magnitude. Therefore, the reproduction will have a special reflection factor diagram having a shape in which a large and flat peak is observed in the wavelength range of 600–700 nm on top of another flat zone observed in the wavelength range of 500–600 nm. Since the human relative luminosity curve shows marginal sensitivity in the wavelength range beyond 650 nm, the human sense of sight will be more stimulated by the wavelength range of 600–650 nm. This means the reproduction is seen as red. Here, it is noted that all of the monochromatic lights recognized within the wavelength range of 600–700 nm are represented as a compound light having the wavelength range entirely covering 600–700 nm. This color changing phenomenon is true also for the blueviolet range with the wavelength range of 400–500 nm and for the green range with the wavelength range of 500–600 nm.

This color changing effect is caused, since (1) the spectral reflection characteristic of a reproduction, produced by the color reproduction process utilizing photosensitive emulsion or material, is considerably different from that of the original color, and since (2) this change in spectral reflection characteristic gives much more influence to the human sense of sight due to the non-linear characteristic thereof. Therefore, this color changing effect is defined as an effect to change color caused by (1) the change in the spectral reflection characteristic for a reproduction of a specific kind of coloring matter having a strong spectral reflection factor in the wavelength range in which the magnitude of the human spectral luminous sensitivity is marginal, which is produced by the color reproduction process utilizing photosensitive emulsion or material having spectral sensitivity in at least one of the wavelength ranges consisting of the human visual range and the adjacent wavelength ranges, and by (2) magnification of the effect to the human sense of sight, because the change takes place in the wavelength range of 400–500 nm or 600–700 nm in which the human relative luminosity curve shows a sharp rise from zero.

Figure 4:
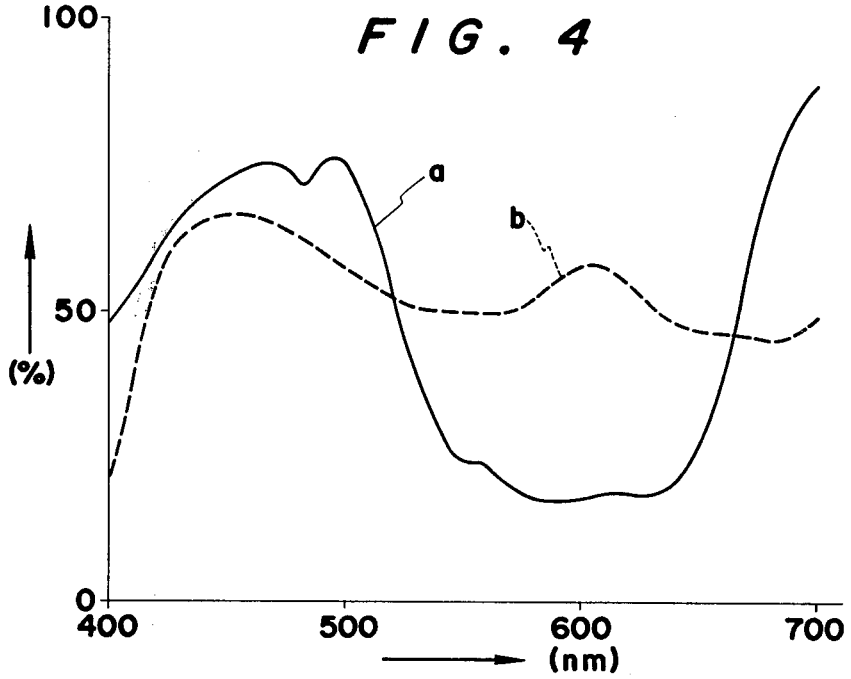
FIG. 4 is a diagram showing the spectral sensitivity of cobalt blue and the reproduction thereof by means of the color copying process.

A preferable example of the color changing effect will be described below. Referring to FIG. 4 which shows the spectral reflection factor diagram of cobalt blue (hereinafter referred to as (4a)) and the spectral reflection factor diagram of the reproduction of the same (hereinafter referred to as (4b)) produced by means of a Fuji CB color copier, model CB 430, produced by Fuji Photografic Film Co. of Japan. In the figure, the curve (a) represents the spectral reflection factor diagram of the coloring matter (4a) and the curve (b) represents that of the coloring matter (4b). Though curve (a) shows a sharply raised and strong spectral reflection factor range in the wavelength range beyond 650 nm, since the magnitude of the human spectral luminous efficacy is marginal in the wavelength range, the human sense of sight is stimulated only by the other strong spectral reflection factor range in the wavelength range of 400–500 nm, particularly by the wavelength range of 450–500 nm in which the human sense of sight has a rather strong sensitivity. As a result, coloring matter (4a) is seen as blue. However, curve (b) shows a considerably different characteristic, in which the spectral reflection factor in the wavelength range of 550–650 nm was increased. Therefore, coloring matter (4b) was changed in color and it is not seen as blue. As a result, an object colored with a kind of coloring matter having this color changing effect does not allow the color reproduction processes to be made by utilizing photosensitive emulsion or material to produce a reproduction having a color similar to that of the original.

Figure 5:
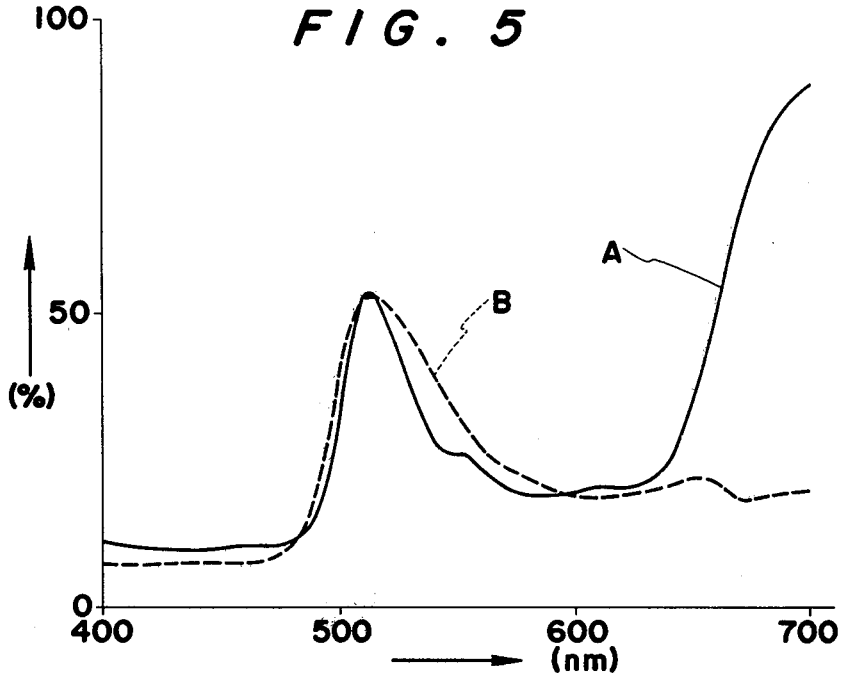
FIG. 5 is a diagram comparing the spectral reflection factors of a kind of coloring matter produced by kneading one portion of cobalt blue and also one portion of disazo compound yellow and of chromium oxide.

The principle of this color changing effect will be described below, referring to a more preferable example. FIG. 5 compares the spectral reflection factors of a kind of coloring matter, produced by kneading one part cobalt blue with one part disazo compound yellow (hereinafter referred to as (A)), and of chromium oxide (hereinafter referred to as (B)). Referring to FIG. 5, curves A and B respectively represent the spectral reflection factor curves of the coloring matters (A) and (B). Within the wavelength range of 400–650 nm, both kinds of coloring matter show the same tendency in the spectral reflection characteristics. However, in the wavelength range beyond 650 nm, coloring matter (A) has a sharply raised strong spectral reflection factor range. Despite this, coloring matter (B) has a rather weak spectral reflection factor range. Since the magnitude of the human spectral luminous efficacy is marginal in the wavelength range in which the difference is observed for the spectral reflection characteristics, the human sense of sight can not distinguish one of these kinds of coloring matter from the other. As a result, when exposed to white light, the combined kinds of coloring matter (A) produce reflections similar to that of coloring matter (B), and both of them are seen as blue green. The reproductions of these kinds of coloring matter (A) and (B), however, produced by means of a Fuji CB color copier, model CB 430, give the spectral reflection factor diagram shown in FIG. 6. The figure is interpreted as follows. As to curve A'; (1) the sharply raised strong spectral reflection factor range disappears from below the wavelength range close to 512 nm and beyond 660 nm, (2) a strong spectral reflection factor range appeared in the wavelength range of 600–700 nm, (3) the magnitude of the spectral reflection factor increased in the wavelength range of 500–600 nm and (4) the variation in the magnitude of spectral reflection factor was moderated. On the other hand, as to curve B', no difference is observed from curve A' in the wavelength range of 400–530 nm, (2) no notable change was made for the wavelength range of 600–700 nm. As a result, the effect of the color reproduction process toward coloring matter (B) is not substantial and is limited to the chroma, causing no change in color. However, the effect of the same color reproduction process toward coloring matter (A) is considerably large, resulting in a change in color from blue to yellow or dark red.

Based on the principle of the subtractive color mixing process, the reasons why the same process caused different effects depending on the kinds of coloring matter applied thereto are considered as follows: (1) Although a spectral reflection factor range which is sharp in rise, high in value and wide in the width of the wavelength range exists in the less visible wavelength range beyond 650 nm, the human sense of sight can not recognize the reflection from this wavelength range. (2) The colors of both coloring matters (A) and (B) are determined by the reflection from the wavelength range close to 512 nm, and both are seen as the same color. (3) Due to the effects caused by the subtractive color mixing process, the reproduction of coloring matter (A) gained a strong and broad spectral reflection range in the wavelength range of 600–700 nm. (4) Out of the wavelength ranges of 600–700 nm, the wavelength range of 600–650 nm in which the magnitude of the human spectral luminous efficacy is large determined the color of the reproduction.

Gray is also considered to have a considerable magnitude of the color changing effect. In other words, when a spectral reflection factor diagram shows a flat curve along the entire wavelength range, excepting the wavelength range in which the human spectral luminous efficacy is marginal, the corresponding coloring matter is seen as gray. However, if the spectral reflection factor diagram shows a notable spectral reflection factor in at least one of the wavelength ranges of 650–700 nm and 400–450 nm, the reproduction of the coloring matter made by utilizing photosensitive emulsion is seen in red or in blue.

Three independent groups of coloring matter are included in the coloring matter having the color changing effect to which this invention is directed. The required characteristic of the first group is that (1) a notable spectral reflection range exists in the wavelength range of 400–450 nm preferably 420–450 nm and/or 650–700 nm preferably 650–680 nm, (2) the notable spectral reflection range supplies sufficient quantity of light to the photosensitive materials employed for the color reproduction process, (3) the magnitude of the notable spectral reflection factor is large and the difference between the magnitude and that of the wavelength slightly longer than 450 nm or slightly shorter than 650 nm is 30% or more, preferably 40% or more, and (4) the value of the spectral reflection factor at the wavelength slightly longer than 450 nm or slightly shorter than 650 nm is 40% or less, preferably 30% or less. The required characteristic of the second group is that, in addition to the three items specified for the first group, the value of the spectral reflection factor is approximately uniform for the entire wavelength range, excepting the wavelength range shorter than 450 nm or longer than 650 nm. This means the coloring matter is seen in gray by men. The required characteristic of the third group is that, in addition to the three items specified for the first group, the coloring matter has one or more sharply risen highly peaked spectral reflection range to determine the color of the coloring matter at some wavelength range within the wavelength range of 450-650 nm. This means the color of such coloring matter is either blue, green, violet, or some others.

Included in the coloring matter having the color changing effect to which this invention is directed are some kinds of inorganic pigment, some kinds of dye for cotton and some kinds of dye for polyester. More specifically, in addition to the coloring matter produced by kneading disazo compound yellow and cobalt blue referred to in the above, included are cobalt blue light, cobalt blue deep, deep cobalt violet, peacock blue A, carbazole violet, chromophthal violet B (Ciba Geigy make), and the like.

Completely no restrictions are imposed for the process to represent colored patterns on an object to implement this invention. In other words, any process for representation of colored patterns is acceptable. In addition to hand writing, any type of color representation process including letter press printing process, lithographic printing process, intaglio printing process and the like is acceptable. Further, no restrictions are imposed for the quality of the document or object to be represented by the colored patterns. In other words, any kind of object is acceptable, including paper, metal, wood, cloth, synthetic resin, and the like, and all are termed a document for convenience.

Figure 6:
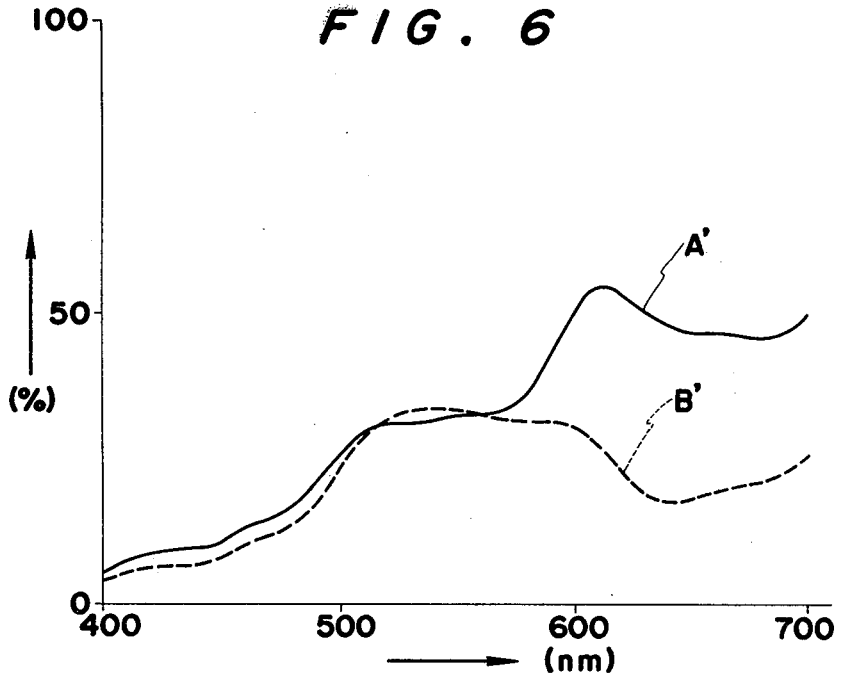
FIG. 6 is a diagram comparing the spectral reflection factor of reproductions, produced by means of a Fuji CB color copier, model CB 430, of a kind of coloring matter produced by kneading one portion of cobalt blue and also one portion of disazo compound yellow and of chromium oxide.

When two kinds of coloring matter, referred to in the explanation made referring to FIGS. 5 and 6, are used for production of a hidden mark, a remarkable effect can be expected for prevention of forgery. In other words, when a pattern represented with a kind of coloring matter having the color changing effect is surrounded by the other kind of coloring matter which is seen in the same color as the above and which does not have the color changing effect, the pattern becomes visible on a reproduction made by utilizing photosensitive emulsions or materials, though it can not be distinguished from the surrounding background on the original. In this case, when the difference in the magnitude of the reflection factor between the pattern and the background is 30% or more, preferably 40% or more, on the reproduction, a notable effect can be expected.

A preferred embodiment and example of the invention is shown below:

A pattern reading "This is a copy" was placed on a piece of fine quality paper with a kind of coloring matter which is a mixed composite containing one part of cobalt blue and one part of disazo compound yellow and which has a spectral reflection characteristic shown in FIG. 5(A). The space surrounding the above pattern was filled with another kind of coloring matter which is a mixture composite containing chromium oxide and which has a reflection factor characteristic shown in FIG. 5(B). Though the human sense of sight can not distinguish the pattern from the background, the photograph taken with KODAK EKTACHROME 64 Professional Film made by Eastman Kodak Co. of the U.S.A. presented the pattern reading "This is a copy" in red green on the background in green. A reproduction of the same by means of a Fuji CB color copier made by Fuji Photographic Film Co. of Japan also presented a similar pattern. The reflection factors of the coloring matter (A) in the wavelengths of 650 nm, 680 nm and 700 nm are, respectively, 30%, 80% and 90%. The reflection factors of the coloring matter (B) in the wavelengths of 650 nm, 680 nm and 700 nm are, respectively, 22%, 20% and 19%.

In conclusion, according to this invention, disadvantages pointed out above involved with the prior art, are removed. An object representing patterns thereon in accordance with this invention does not allow the color reproduction process to be made by utilizing photosensitive emulsion or material to make reproduction thereof in a color accurately resembling that of the original. The object is thus possibly utilized as an object whose reproduction is undesirable. An object representing patterns thereon in accordance with this invention allows non-professional personnel to distinguish a reproduction produced by utilizing photosensitive emulsion, from the original resulting in an effect to discourage a potential forger to try and circulate the forgery in the market place and in another effect not to allow the forgery to circulate in the market place. An object representing patterns thereon in accordance with this invention is possible to be produced without using any particular plates or blocks for printing purpose or any particular printing process, resulting in a reduction of cost for prevention of forgery of articles whose reproduction is undesirable.

While specific embodiments of the invention have been shown and described in detail to illustrate the application of the principles of the invention, it will be understood that the invention may be embodied otherwise without departing from such principles.

What is claimed is:

1. A method of preventing color accurate reproduction of a colored pattern with color photocopiers and color photography using photosensitive materials having spectral sensitivity in the wavelength ranges consisting of the human visible range and adjacent wavelength ranges thereto, comprising, forming at least a portion of the colored pattern with a color material having a spectral reflection factor curve with high spectral reflection in at least one of the areas of wavelength below 450 nm and above 650 nm so that a reproduction of the colored pattern is in a color not perceived by a direct human viewer of the colored pattern, and forming said at least one portion of the colored pattern with a color material having a spectral reflection factor curve with high spectral reflection in at least one area between 450 nm and 650 nm whereby said at least one portion of the colored pattern is viewed in a viewing color different from a reproduced color reproduced by the color photocopiers and color photography, said colored pattern being formed with said color material having a spectral reflection factor curve with high spectral reflection factors in at least one of the areas of wavelength below 450 nm and also above 650 nm and in at least one area between 450 nm and 650 nm and a color material having the same hue as that of the viewing color but scarcely having any reflection factor in the areas of wavelength below 450 nm and above 650 nm, whereby a human viewer identifies said colored pattern as a uniform hue but identifies the reproduction of the same as a combination of different hues.

2. A method according to claim 1, including forming said color material by kneading together a portion of cobalt blue with a portion of disazo compound yellow, forming a remainder of said colored pattern with chromium oxide, whereby, to a human observer, both said at least one portion of the colored pattern and the remainder of the colored pattern appear to be blue green and a reproduction of the entire color pattern produces a change in said at least one portion thereof having said color material.

3. A method according to claim 1, wherein one part each of cobalt blue and disazo compound yellow are mixed together.

4. A method of preventing color accurate reproduction of a colored pattern with color photocopiers and color photography using photosensitive materials having spectral sensitivity in the wavelength ranges consisting of the human visible range and adjacent wavelength ranges thereto, comprising, forming at least a portion of the colored pattern with a color material having a spectral reflection factor curve with high spectral reflection in at least one of the areas of wavelength below 450 nm and above 650 nm so that a reproduction of the colored pattern is in a color not perceived by a direct human viewer of the colored pattern, and forming said at least one portion of the colored pattern with a color material having a spectral reflection factor curve with high spectral reflection in at least one area between 450 nm and 650 nm whereby said at least one portion of the colored pattern is viewed in a viewing color different from a reproduced color reproduced by the color photocopiers and color photograpy, said colored pattern being formed with said color material having a spectral reflection factor curve with high spectral reflection factors in at least one of the areas of wavelength below 450 nm and above 650 nm and also in at least one area between 450 nm and 650 nm and whose reproduction has the same hue as that of a second color material, said second color material having a hue different from that of the viewing color and scarcely having any reflection factor in the areas of wavelength below 450 nm and above 650 nm, whereby a human viewer sees said colored pattern as a combination of different hues but sees said reproduction of the same as a uniform hue so that he can not identify said reproduction as said combination of different hues.

5. A method of preventing color accurate reproduction of a colored pattern with color photocopiers and color photography using photosensitive materials having spectral sensitivity in the wavelength ranges consisting of the human visible range and adjacent wavelength ranges thereto, comprising, forming at least a portion of the colored pattern with a color material having a spectral reflection factor curve with high spectral reflection in at least one of the areas of wavelength below 450 nm and above 650 nm so that a reproduction of the colored pattern is in a color not perceived by a direct human viewer of the colored pattern, and forming said at least one portion of the colored pattern with a color material having a spectral reflection factor curve with high spectral reflection in at least one area between 450 nm and 650 nm whereby said at least one portion of the colored pattern is viewed in a viewing color different from a reproduced color reproduced by the color photocopiers and color photography, said colored pattern being formed with said color material having a spectral reflection factor curve with high spectral reflection factor factors in at least one of the areas of wavelength below 450 nm and above 650 nm and also in at least one area below 450 nm and 650 nm and whose reproduction has a hue different from that of a second color material, said second color material having a hue different from the viewing color and scarcely having any reflection factor in the areas of wavelength below 450 nm and above 650 nm whereby a human viewer can identify the reproduction of said colored pattern is different from said colored pattern.

6. A method of preventing color accurate reproduction of a colored pattern with color photocopiers and color photography using photosensitive materials having spectral sensitivity in the wavelength ranges consisting of the human visible range and adjacent wavelength ranges thereto, comprising, forming at least a portion of the colored pattern with a color material having a spectral reflection factor curve with high spectral reflection in at least one of the areas of wavelength below 450 nm and above 650 nm so that a reproduction of the colored pattern is in a color not perceived by a direct human viewer of the colored pattern, and forming said at least one portion of the colored pattern with a color material having a spectral reflection factor curve with high spectral reflection in at least one area between 450 nm and 650 nm whereby said at least one of the colored pattern is viewed in a viewing color different from a reproduced color reproduced by the color photocopiers and color photography, said color material of said at least one portion of said colored pattern being formed by combining three groups of materials, the first one having a relatively high spectral reflectivity in at least one of the ranges between 400 and 450 nm and between 650 and 700 nm which is at least 30% higher than reflectivity of the first group material in one of the areas slightly longer in wavelength than 450 nm and slightly less in wavelength than 650 nm respectively, the second material having substantially the same spectral reflectivity throughout the visible range whereby its color appears as gray and the third material having at least one peak higher than the level of said material within the visible range.

* * * * *